US006745496B2

(12) United States Patent
Cassella

(10) Patent No.: US 6,745,496 B2
(45) Date of Patent: Jun. 8, 2004

(54) AIR-FLOW DRYER AND METHOD

(76) Inventor: Anthony Cassella, BCT 516 Cushing Rd. - Unit 200, Warren, ME (US) 04864-4602

( * ) Notice: Subject to any disclaimer, the term of this patent is extended or adjusted under 35 U.S.C. 154(b) by 22 days.

(21) Appl. No.: 10/100,214

(22) Filed: Mar. 18, 2002

(65) Prior Publication Data

US 2002/0133969 A1 Sep. 26, 2002

Related U.S. Application Data

(60) Provisional application No. 60/276,985, filed on Mar. 20, 2001.

(51) Int. Cl.[7] ..... F26B 9/00

(52) U.S. Cl. ..... 34/621; 34/218; 34/235

(58) Field of Search ..... 34/528, 534, 546, 34/562, 90, 107, 103, 618, 621, 202, 210, 215, 218, 235, 603, 604, 138, 239, 240; 211/113, 123, 204; 223/68, 70, 92; 312/109; 219/385

(56) References Cited

U.S. PATENT DOCUMENTS

| | | | | | |
|---|---|---|---|---|---|
| 2,091,746 | A | * | 8/1937 | Wiley | 219/474 |
| 2,561,652 | A | * | 7/1951 | Doolan | 34/82 |
| 3,475,828 | A | * | 11/1969 | Feldman et al. | 34/443 |
| 3,739,496 | A | * | 6/1973 | Buckley et al. | 34/210 |
| 3,805,561 | A | * | 4/1974 | Bullock | 68/5 C |
| 4,625,432 | A | * | 12/1986 | Baltes | 34/621 |
| 4,682,424 | A | * | 7/1987 | Irving | 34/621 |
| 5,016,364 | A | * | 5/1991 | Cochrane | 34/202 |
| 5,094,020 | A | * | 3/1992 | Wingfield et al. | 38/1 A |
| 5,152,077 | A | * | 10/1992 | Liang | 34/77 |
| 5,315,765 | A | * | 5/1994 | Holst et al. | 34/260 |
| 5,369,892 | A | * | 12/1994 | Dhaemers | 34/275 |
| 5,546,678 | A | * | 8/1996 | Dhaemers | 34/275 |
| 5,555,640 | A | * | 9/1996 | Ou | 34/202 |
| 5,815,961 | A | * | 10/1998 | Estes et al. | 38/14 |

* cited by examiner

*Primary Examiner*—Ira S. Lazarus
*Assistant Examiner*—Andrea M. Ragonese
(74) *Attorney, Agent, or Firm*—Michael J. Persson; Lawson & Persson, P.C.

(57) ABSTRACT

The invention is an apparatus and method for drying and de-wrinkling an article of clothing, which includes a housing having an upper compartment, a lower compartment, and a dividing wall separating the compartments. An exhaust hole is disposed through one side of the upper compartment of the housing, and an intake hole and an outflow hole are disposed through the dividing wall. A mechanical assembly is disposed within the upper compartment and includes a fan, heater, thermostat and humidity sensor. An exhaust fan is in fluid communication with the exhaust hole and is adapted to control a flow of air through the exhaust hole in the side of the housing. A control system is disposed within the upper compartment and accepts an input from a user, a temperature input, and a humidity input, and controls the heater, the fan and the exhaust fan based upon the temperature input and the humidity input.

17 Claims, 4 Drawing Sheets

AIR-FLOW DRYER AND METHOD

CLAIM OF PRIORITY

This application claims the benefit of United States Provisional Patent Application Ser. No. 60/276,985, filed Mar. 20, 2001.

FIELD OF THE INVENTION

The present invention relates to the field of drying devices and, in particular, to a device and method for drying and de-wrinkling articles of clothing utilizing a flow of air.

BACKGROUND OF THE INVENTION

The inventor conceived of the present invention in response to a need that surfaced in his automobile and truck restoration business. At the time, he had seven shops and eighty-six employees. An accountant brought the business' exorbitant cleaning expenses to the attention of the inventor, who was always looking for creative ways to ensure quality and control costs. Full-time mechanics needed sharp-looking uniforms to be cleaned quickly and without ironing in machines that could be operated by unskilled, part-time employees. Thousands of rags and chamois required rapid cleaning.

Despite this need, conventional cleaning and drying equipment failed to provide an effective solution. For example, conventional dry cleaning equipment is large, expensive, requires the use of harmful chemicals, and requires trained operators in order to effect satisfactory results. Because of these factors, such equipment is not readily available or desirable to individuals or small businesses.

Conventional wet washing and tumble-drying machines are effective at cleaning and drying clothing, and are readily available, and affordable, to individuals and small businesses. However, conventional tumble-drying typically results in dried clothes that are wrinkled and, therefore, not suitable for wear without de-wrinkling via ironing, steaming, or other art recognized means.

A number of non-tumble type dryers have been developed and patented. However, each of these fails to solve the problems encountered by the inventor of the present invention. For example, U.S. Pat. No. 5,555,640, titled "Household Drying Center", discloses a multipurpose household drying center in which a blower and heating chamber are disposed on the top portion of a cabinet to generate forced and heated air downward into a drying chamber in the cabinet below the heating chamber. There are horizontally disposed heat diffusion plates under the heating chamber and vertically disposed air ducts on the side walls of the cabinet to enable heated air to be evenly distributed and filled in the drying chamber for uniform drying of the goods held therein. A support stand having a horizontal and rectangular frame secured on the top ends of a pair of spaced and vertical telescopically structured tubes is disposed within the drying chamber for hanging clothes, and can support a wire basket for holding delicate or odd shape goods for drying. There are side rods on the sidewalls for hanging articles, and a base grid is provided above the bottom wall to hold heavy or odd shape goods for drying.

The above referenced patent states "clothes and goods are dried without tumbling, thus avoiding fraying or wrinkles." However, this is not the case as the drying center fails to monitor and adjust the air for temperature and humidity, which are the primary factors in reducing wrinkles. Further, it requires that that same hot air be utilized for drying, creating a risk of damage to the clothing being dried and the risk of burns to users. Accordingly, although a distinct improvement over conventional tumble dryers, this drying center does not produce the level of sharp, wrinkle free clothing required to meet the needs of the inventor nor does it provide any safeguards against damage to clothing or injury.

U.S. Pat. No. 4,682,424, titled "Clothes Drying Apparatus", describes yet another non-tumble style drying apparatus that includes a hanger rod mounted above a drip pan element, that may be slidably removed from a drying cabinet so that wet clothing articles may be easily mounted on the hanger rod. The patent discloses a system that is similar to that disclosed in U.S. Pat. No. 5,555,640, and further includes an automatic control so that the drying cycle may be pre-selected so as to achieve the most efficient drying of the clothing articles. However, this apparatus also has distinct drawbacks that make it unsuited to satisfactorily solving the problems solved by the present invention. For example, like the dryer of U.S. Pat. No. 5,555,640, this apparatus fails to monitor and adjust the air for temperature and humidity, which are the primary factors in reducing wrinkles. Further, it likewise requires that that same hot air be utilized for drying, creating a risk of damage to the clothing being dried and the risk of burns to users.

Another non-tumble dryer is disclosed in U.S. Pat. No. 5,815,961, titled "Clothes Treating Cabinet with Inflatable Hanger". This patent discloses a clothes treating apparatus having a cabinet that defines an interior region for receiving clothes. The interior region has opposed inner side surfaces and a door is connected to the cabinet for closing the interior region. An inflatable hanger for supporting shirt-like clothes items is disposed within the interior region and is in communication with a blower that selectively inflates the inflatable hanger for pressing the shirt-like clothes item against the cabinet inner side surfaces. A steam generation means is provided for introducing moist air into the cabinet for humidifying the clothes item disposed therein. A heater and fan supply heated air into the interior region for drying the shirt-like clothes items disposed therein. During the de-wrinkling cycle, steam is introduced into the interior region while the inflatable hanger assembly is periodically inflated. Following the steaming period, the inflatable hanger is inflated while the clothes are subject to warm air such that the clothes wrinkles are pressed out and the clothes are partially dried, setting the clothes in a smooth appearance. Heated air is then delivered into the interior region to completely dry the clothes item.

This system claims to be effective at de-wrinkling already dried clothes, but has inherent drawbacks. The first, and foremost, of these drawbacks is the need to carefully arrange the clothing and inflatable hanger to avoid any unwanted creasing of the garment. If the hanger and clothing are not properly arranged, the inflation of the hanger will cause the garment to fold upon itself and cause a crease or wrinkle in an unwanted area. Another drawback is that the inflation of the hanger is unsuited for garments, such as pants or skirts, that require creases to be formed in the material. Another drawback is the increased cost involved in manufacturing an inflatable hanger and the need for hangers of many sizes to accommodate the many sizes of garments. Finally, the need to generate a separate flow of steam over the garment is undesirable due to the safety hazard attendant to live steam, the need to pipe in a source of water, or continually refill a water reservoir, and the increased cost in providing means for heating and distributing the steam. Accordingly, the system described in U.S. Pat. No. 5,815,961 is not effective at solving the problem of the present invention.

A drying apparatus and method that allows clothes to be cleaned quickly and without ironing or use of another appliance, that may be operated by unskilled, part-time employees, that does not require a large initial investment, a large space or the use of hazardous chemicals or live steam, that effectively removes wrinkles while drying, that does not risk the creation of additional wrinkles, that may be mounted anywhere within a home, and that does not require piping or constant filling of a water reservoir, is not known in the art.

SUMMARY OF THE INVENTION

The present invention is a drying apparatus and method that overcomes the drawbacks inherent in the prior art by removing wrinkles from clothes and drying them in a single appliance using a controlled flow of air through a small space without a conventional tumble drum.

The drying apparatus of the present invention utilizes forced air to dry clothes without tumbling them. A wind-tunnel effect, combined with the process of drying fabric from the top down create a new way to dry clothes that is superior to that in the industry today. The dryer of the present invention effectively dries and de-wrinkles clothing by passing a volume of high velocity air downward onto the article of clothing, which tends to move the water from the top of the article of clothing downward. The congregation of this water at the bottom of the article acts as a weight and places the article in tension, effectively preventing the formation of wrinkles. The inclusion of an exhaust vent and exhaust fan aid in the drying process by circulating the airflow through the drying compartment, effectively removing excess humidity that tends to prevent full and rapid drying of the clothing. Further, because the volume and velocity of air passing over the clothing are the primary means for drying, the drying apparatus of the present invention effectively dries clothing using warm air, or ambient temperature air, rather than the high temperature air utilized in conventional dryers.

The working model size includes a housing that is dimensioned to be sixty inches tall, twenty-four inches wide and eleven inches deep. However, larger and smaller models based on the same process and design as the preferred embodiment have been tested and are likewise effective at solving the above mentioned problems inherent in the prior art. The preferred housing is manufactured primarily of wood, as a wooden housing provides the unit with a "furniture" look that allows it to fit in with the decor of a non-utility type room. However, it is envisioned that housings manufactured of sheet metal, or molded from polymer materials, may be substituted to achieve similar results.

The preferred drying apparatus presents as a tall box of relatively shallow depth with a door mounted on the front. The door preferably swings open on a hinge. Inside, there are two compartments; a lower compartment and an upper compartment, which are separated by a dividing wall. The lower compartment is the drying compartment, where the article of clothing is hung for drying. The upper compartment is the mechanical compartment from which the airflow into the lower compartment is created.

The upper compartment houses a mechanical assembly that preferably includes a heating unit, thermostat, humidity sensor, timer switch, fan, and a power converter, which are referred to collectively herein as the "mechanical components" of the dryer. In some embodiments of the invention, the heating unit, thermostat and humidity sensor are eliminated and the dryer performs its drying and de-wrinkling function utilizing air of ambient temperature. In still others, a separate intake fan and exhaust fan are utilized. In the preferred embodiment, some, or all, of the mechanical components are combined into one assembly, while in other embodiments each mechanical component is purchased separately and integrated together into the mechanical assembly by the manufacturer of the dryer.

The mechanical assembly is preferably controlled via a control system that includes a control console disposed upon the exterior surface of the upper compartment. The control system preferably includes a number of predetermined drying settings, such as permanent press, cotton, linen, or the like, corresponding to the type of garment to be dried, and selectable via a button, knob, or other art recognized control, disposed upon the console. However, other embodiments utilize analog controls that are manually set to controlling airflow, air temperature and/or drying time.

The upper compartment of the preferred embodiment also includes three vent holes through which air is moved to effect the drying and de-wrinkling of the clothing. The first and second holes are the air intake and air outflow vent holes through the dividing wall that place the upper and lower compartments into fluid communication with one another. The third vent hole is an exhaust vent, which is preferably mounted on one side of the unit. Because air is exhausted through this vent, these embodiments of the dryer must be mounted such that air may enter and escape therethrough. This is preferably accomplished by leaving a space between the dryer and an interior wall of the room in which it is disposed to allow the air to mingle with the interior of the room. This is preferred as it eliminates the need for unsightly and heat robbing exterior ducts. Such an arrangement presents a distinct benefit over present tumble dryers, which cannot be so vented due to the production of lint and other fiber particles that are hazardous if exhausted into an enclosed space. However, it is recognized that the exhaust vent may be attached to a conventional exterior duct through the building exterior to achieve similar results.

The lower compartment is of a generally larger size than the upper compartment and is dimensioned to accept an article of clothing. In the preferred embodiment of the invention, the lower compartment includes a hanging device, such as a hook or wire, positioned near the top of the compartment and dimensioned to accept standard-sized coat hangers. The preferred lower compartment also includes holes through the compartment to allow air to exhaust from the compartment to the ambient air.

In operation, an article of wet clothing is hung on a coat hanger, which is disposed upon the hanging device in the lower compartment of the preferred dryer. The door is then closed and the control console is manipulated to a setting corresponding to the garment to be dried. The fan and the heating system are energized to cause a flow of heated air to flow through the heater outflow vent hole and into the lower compartment. Because the exhaust fan has not been energized, this air is forced to both re-circulate up through the heater intake vent and through the heater, and to exhaust through the vent holes in the lower compartment. When a set temperature and/or humidity has been reached, the exhaust fan is energized and begins to exhaust the moist air through the exhaust vent at a controlled rate until the end of the cycle.

In the most basic embodiment of the dryer, the exhaust vent, fan, heater, thermostat and humidity sensor of the preferred embodiment are eliminated, and air-flow alone is used to dry and de-wrinkle the article of clothing. In these embodiments, ambient temperature air of relatively high velocity is blown downward over the clothing, forcing the moisture downward towards the bottom of the article of clothing, and is exhausted through holes in the bottom of the lower compartment. As was the case with the preferred embodiment, the buildup of moisture at the bottom of the article causes the article to be placed in tension, effectively preventing wrinkles from forming. Further, because no heater is utilized, the power consumed by this unit, the overall cost of manufacturing, and the risk of damage to clothing are significantly lower.

Therefore, it is an aspect of the invention to provide a drying apparatus that blows air from the top down, using the wet portions of the garment to place the garment in tension to prevent the formation of wrinkles.

It is a further aspect of the invention to provide a drying apparatus that may utilize only a flow of ambient temperature to effect drying.

It is a further aspect of the invention to provide a drying apparatus that utilizes an exhaust vent and fan that is energized when a predetermined temperature and/or humidity is reached.

It is a further aspect of the invention to provide a drying apparatus that controls the temperature and humidity of the drying air via manipulation of the exhaust fan.

It is a further aspect of the invention to provide a drying apparatus that allows exhaust air to be vented directly into a room.

It is a further aspect of the invention to provide a drying apparatus that may be utilized as an air-freshener.

It is a further aspect of the invention to provide a drying apparatus that maybe adapted for use as a boot or shoe dryer.

It is a still further aspect of the invention to provide a drying apparatus that may be safely used around children.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
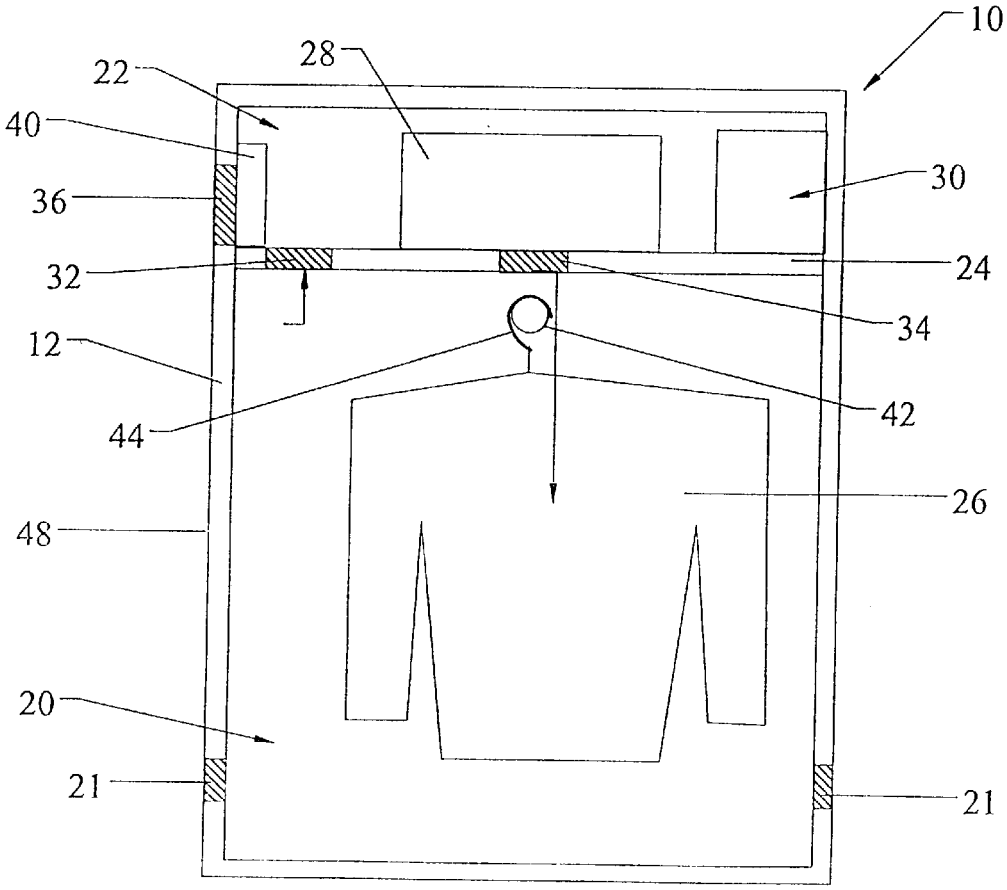
FIG. 1 is a diagrammatic view of the front of the preferred drying apparatus of the present invention with the door removed to show the location of the upper and lower compartments and the flow of are therethrough.

Referring first to FIG. 1, the preferred drying apparatus 10 of the present invention includes a housing 12 that presents as a tall box of relatively shallow depth and having a substantially open front. Inside of the housing 12 is a lower compartment 20 and an upper compartment 22, which are separated by a dividing wall 24. The lower compartment 20 is the drying compartment, where an article of clothing 26 is hung for drying. The upper compartment 22 is the mechanical compartment from which the airflow into the lower compartment 20 is created. The upper compartment 22 houses the mechanical components of the dryer, which are preferably combined into mechanical assembly 28. This mechanical assembly 28 includes all of the components necessary for moving the air through the lower compartment 20 and, in embodiments utilizing heated air, also includes the heater. The mechanical assembly 28 is controlled via a control system 30, which preferably includes a control console disposed upon the exterior surface of the upper compartment 22, as shown in detail in FIG. 4. However, as noted above, other embodiments may utilize analog controls (not shown) that are manually set to control airflow, air temperature and/or drying time.

The upper compartment of the preferred embodiment includes three vent holes 32, 34, 36 through which air is moved to effect the drying and de-wrinkling of the article of clothing 26. The first and second holes are the air inflow hole 34 and air outflow hole 32, which are disposed through the dividing wall 24 and act to place the upper compartment 22 and lower compartments 20 into fluid communication with one another.

The third vent hole is an exhaust vent hole 36, which is preferably on one side 48 of the drying apparatus. Because of the need to expel air through this exhaust vent hole 36, the drying apparatus 10 must be mounted such that air may escape therethrough. This is preferably accomplished by leaving a space between the drying apparatus 10 and an interior wall of the room in which it is disposed to allow the air to mingle with the interior of the room. However, it is recognized that the exhaust vent hole 36 be attached to a conventional exterior duct (not shown) through the building exterior to achieve similar results.

An exhaust fan 40 is disposed in fluid communication with the exhaust vent hole 36 and is utilized to allow the air within the lower compartment 20 to be recirculated or exhausted. As shown in FIG. 1, the exhaust fan 40 is preferably mounted to the interior of the housing 12 proximate to the exhaust vent hole 36. However, it is recognized that the exhaust fan 40 may disposed on the outside of the housing, within the interior and joined to the exhaust vent hole 36 via a duct, or in other locations provided that the exhaust fan 40 is able to control the flow of air through the exhaust vent hole 36. In the preferred embodiment, the exhaust fan 40 is controlled by the control system 30, as described in detail below. However, in other embodiments, the exhaust fan 40 is manually operated via a switch (not shown).

The lower compartment 20 is of a generally larger size than the upper compartment 22 and is dimensioned to accept the article of clothing 26. As shown in FIG. 1, the article of clothing 26 is a shirt. However, it is recognized that the housing may be adapted to dry and de-wrinkle other articles of clothing, or non-clothing items, such as towels, sheets, blankets, or the like. In the preferred embodiment of the invention, the lower compartment 20 of the housing 12 includes a hanging device 42, such as a hook or wire, positioned near the top of the lower compartment 20 and dimensioned to accept standard-sized coat hangers 44, upon which the article of clothing 26 is hung. The preferred lower compartment 20 has a plurality of holes 21 to allow air to escape once it has passed over the article of clothing 26. In the embodiment of FIG. 1, these holes 21 are disposed on the sides of the lower compartment 20. This arrangement is preferable because they allow the unit to sit flat on the ground and allow shoes, boots, sneakers, gloves, hats or the like to be set on the bottom surface of the lower compartment and dried without impacting the flow of air into the lower compartment. However, in embodiments adapted for mounting on a wall or on a stand off the ground, these holes 21 may be disposed in the bottom of the lower compartment 20.

Figure 2:
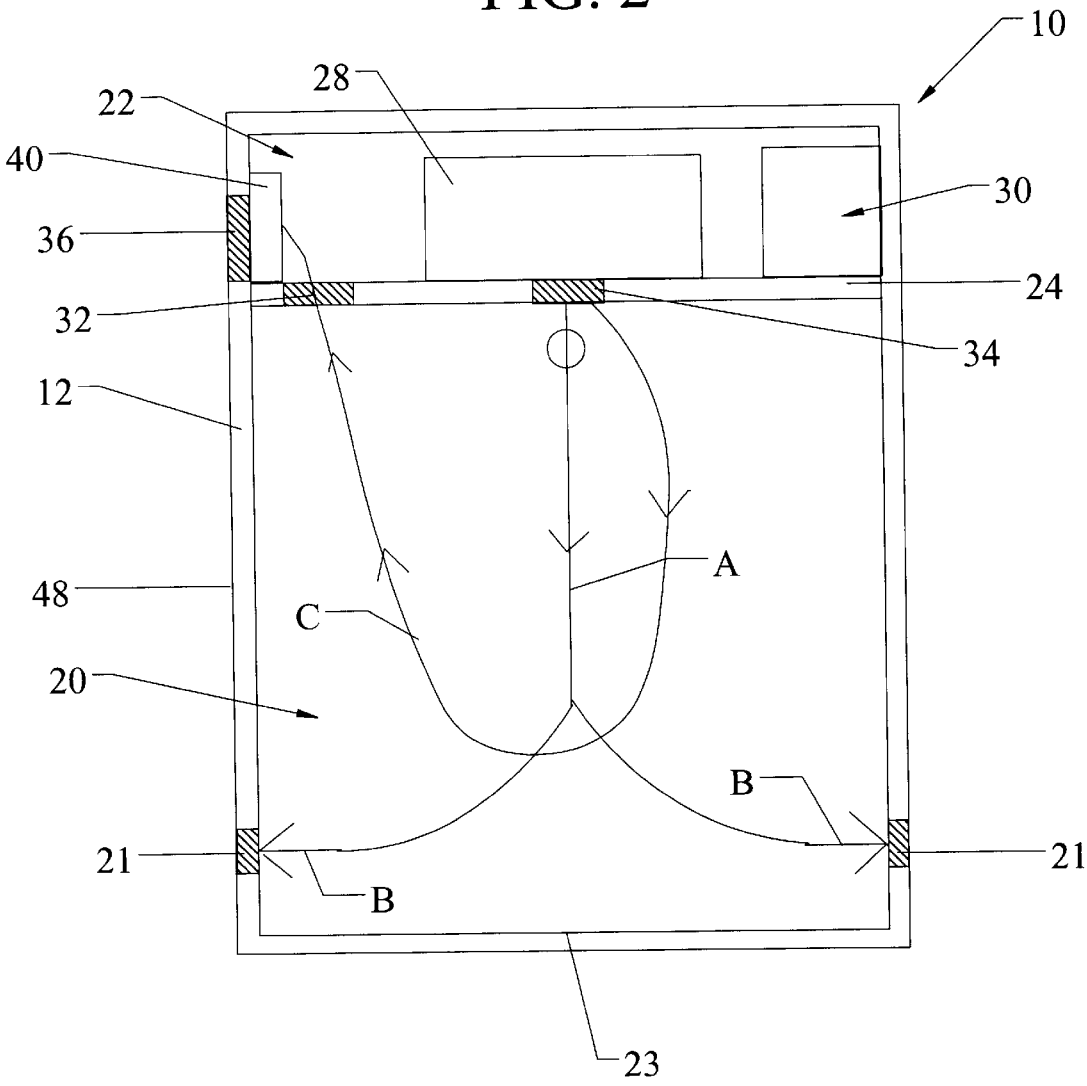
FIG. 2 is a diagrammatic view of the front of the preferred drying apparatus of the present invention with the door removed to show the flow patterns of air through the apparatus with and without the use of the exhaust fan.

Referring now to FIG. 2, the movement of the air within the drying apparatus 10 is shown. First, a flow of air is directed from the mechanical assembly 28 downward in stream A. This flow passes over the article of clothing (not shown), effectively pushing the moisture trapped within the clothing downward. Unless the drying apparatus 10 includes an exhaust fan 40, the air does not circulate upward and out of vent hole 32, but rather continues downward until it impinges upon the bottom 23 of the lower compartment 20 and is deflected upward. This impingement and deflection, coupled with the continued input of air from the mechanical assembly, causes the pressure within the lower compartment 20 to increase, effectively forcing a flow B of the air to be exhausted out of holes 21. The exhaust through holes 21 is effective at reducing the overall pressure within the lower compartment, which allows a higher volume of air at higher velocity to pass over the article of clothing to be dried. However, the flow B through holes 21 is insufficient to remove excess humidity from the lower compartment 20, which acts to prevent adequate drying of the clothing.

Because of the detrimental effect of excess humidity on the drying of the clothing, embodiments that utilize a mechanical assembly 28 having a heater, these embodiments preferably include an exhaust fan 40 for exhausting the humid air from the lower compartment 20. Referring again to FIG. 2, in these embodiments, the air is first heated and is then blown downward from the mechanical assembly along path A, as described above. However, once the heated air causes the humidity within the lower compartment to increase, the exhaust fan 40 is energized. The exhaust fan 40 pulls air from the lower compartment through the outflow vent hole 32 and pushes it out of exhaust vent hole 36, effectively removing the humidity from the lower compartment 20. Accordingly, substantially dry heated air is blown downward from the mechanical assembly 28 and over the clothing, where its velocity pushes the moisture downward and its heat causes some of the moisture to evaporate. The now humid air continues along path C upward and out of the exhaust vent 36 to the ambient air around the apparatus 10. Further, depending upon the relative strengths of the exhaust fan 40 and the fan that is part of the mechanical assembly 28, the pressure within the compartment may increase sufficiently to allow additional air to escape through the holes 21, or to decrease such that ambient air is drawn into the lower compartment through those same holes.

The humidity within the lower compartment 20 may be controlled in a number of ways. In some embodiments, the exhaust fan 40 is energized after a set period of time. This period may be preset, or may be varied depending upon the type of clothing to be dried, but will typically be between five and fifteen minutes after the drying cycle has started. In some embodiments utilizing a timer based control, the exhaust fan 40 is cycled on and off for set periods in order to maximize the airflow downward upon the clothing, while keeping the moisture content of the air within the lower compartment at acceptable levels. In other embodiments, the humidity is controlled by energizing and de-energizing the exhaust fan based upon a measurement of relative humidity made by a humidity sensor or humidistat. In such systems, it is preferred that the relative humidity of the air be maintained below 80%, and that set points for the system be between 50% and 80%. In still other embodiments, such as the working model described below, the exhaust fan 40 is controlled manually via manipulation of a common electrical switch (not shown).

Figure 3:
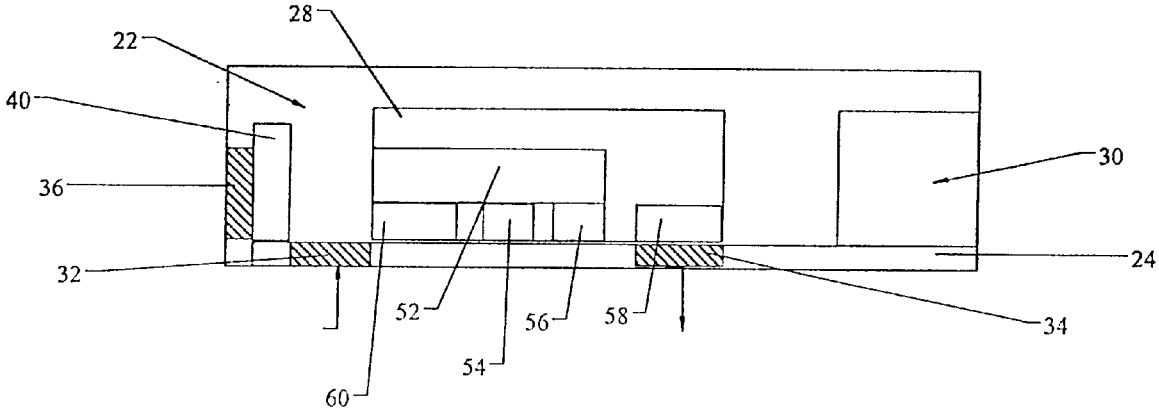
FIG. 3 is a diagrammatic view of one embodiment of the upper compartment showing the relationship between the mechanical components and the flow of air through the holes in the dividing wall.

Referring now to FIG. 3, the upper compartment 22 preferably houses a mechanical assembly 28 that includes a heating unit 52, thermostat 54, a humidity sensor 56, blower 58, and a power converter 60, which are referred to collectively herein as the "mechanical components" of the dryer. In some embodiments, each mechanical component is purchased separately and integrated together by the manufacturer of the dryer. In other embodiments, the mechanical components are combined into one mechanical assembly 28.

The mechanical assembly utilized in the inventor's working model is a Model 658 Heater/Fan sold by the Broan Mfg. Co. Inc. of Hartford, Wis. (hereafter the Broan unit). The Broan unit includes the heater the blower 58, which blows the heated air onto the clothing, and the exhaust fan 40, which exhausts warm, humid air from the lower compartment. Because the Broan unit is designed for use in bathrooms, where excess humidity is a problem, the unit includes a switch that controls the exhaust fan 40. However, the preferred embodiment of the invention does not require manual control of exhaust, but rather utilizes a humidity sensor 56 to automatically control humidity. Likewise, the blower 58 of the Broan unit is designed for bathroom use and, therefore, does not produce the optimal volume and velocity of airflow for drying clothing. Accordingly, the preferred embodiment of the invention utilizes a blower 58 that produces a higher output than is possible with the Broan unit.

The upper compartment 22 also houses a control system 30 for controlling the operation of the drying apparatus. In some embodiments of the invention, the control system 30 is a pair of simple switches (not shown) for manually energizing the blower 58 and exhaust fan 40. In others, the control system 30 includes a programmable controller, microprocessor, or other art recognized means for accepting a user input drying setting and inputs from the thermostat 54, and humidity sensor, and for controlling the operation of the heating unit 52, fan 58 and exhaust fan 40 based upon these inputs. If the control system 30 is digitally controlled, it is preferred that the system 30 includes a microprocessor and a memory into which a control algorithm is stored. However, other embodiments of the control system 30 rely upon analog controls, such as timers, thermostatic switches and analog humidity switches to control the drying of the clothing.

Figure 4:
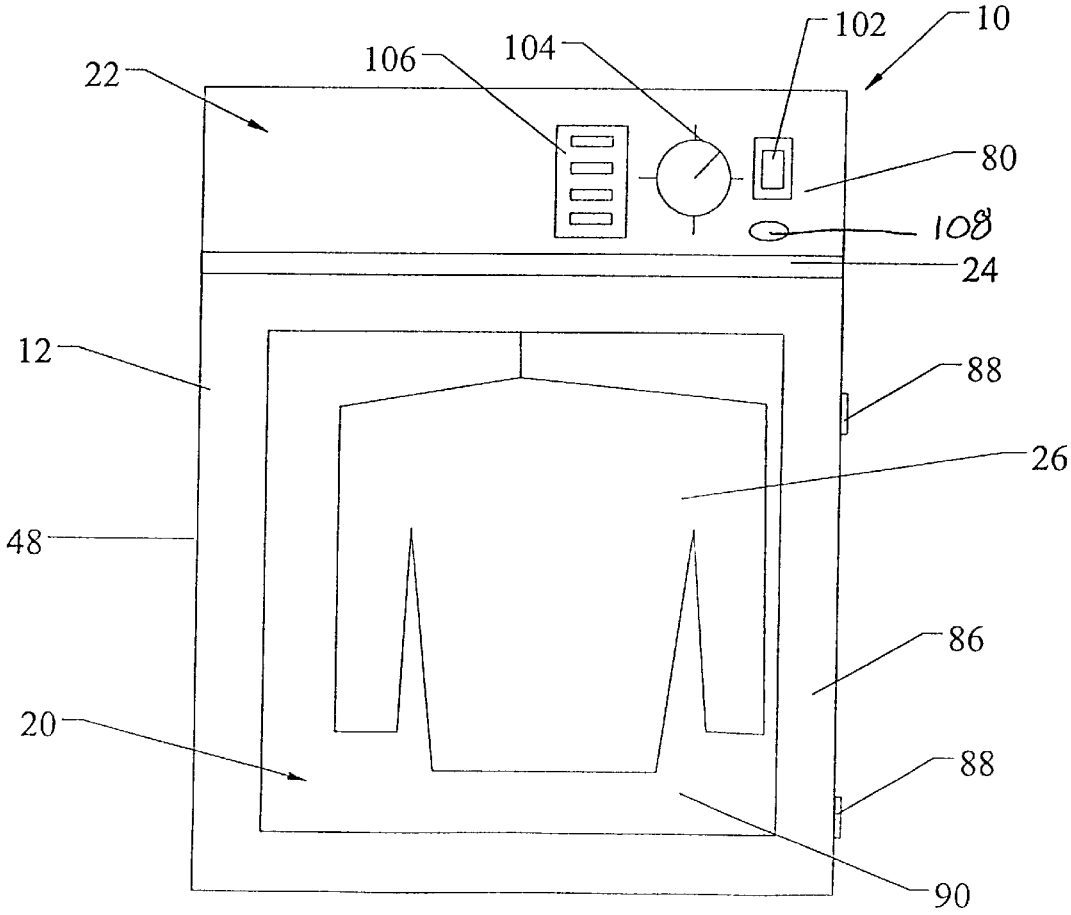
FIG. 4 is a front view of the drying apparatus showing the control console and preferred door.

Referring now to FIG. 4, the front of one embodiment of an assembled drying apparatus 10 is shown. In this embodiment, the user controls, 102, 104, 106 are mounted to a panel 80 on the front of the upper compartment 22 of the housing 12 for easy access by the user. However, in other embodiments, such as the working model, the user controls 102, 104, 106 mounted to the side of the upper compartment 22.

The user controls 102, 104, 106 of the embodiment of FIG. 4 are an exhaust fan control switch 102, a timer switch 104, and a cycle selector 106. The exhaust fan control switch 102 controls the operation of the exhaust fan (not shown), which, as noted above, controls the humidity within the lower compartment 20. However, as noted above, this control switch 102 may be replaced with other automatic methods of controlling humidity.

The timer switch 104 energizes and de-energizes the heater and the blower (not shown) based upon its rotational position. As shown in FIG. 4, the timer switch 104 is a common analog switch, operating in a manner similar to a timed sauna or whirlpool control. However, other art recognized timing devices, such as digital clocks, timing circuits, or the like, may be substituted to achieve similar results.

The cycle selector 106 in the embodiment of FIG. 4 is a series of buttons that allows a user to choose the type of clothing to be dried. As the selector 106 of FIG. 4 does not need to perform any timing or humidity control functions and, therefore is essentially a temperature control, which sets the desired temperature between ambient and two hundred degrees Fahrenheit depending upon the type of clothing to be dried. However, in other embodiments, the cycle selector 106 sets the desired temperature and time for drying. In others, the cycle selector 106 sets temperature, time and humidity set point based upon the clothing to be dried. In still others, the cycle selector 106 sets the time for drying based upon the type and/or number of articles of clothing to be dried.

The control method is preferably performed by the preferred control system 30 described above and includes the steps of accepting inputs from the thermostat, humidity sensor and a user input drying setting, comparing these inputs to a set of control parameters and sending outputs to heating unit, fan and exhaust fan based upon this comparison. It is preferred that the drying settings be settings, such as permanent press, cotton, linen, or the like, which correspond to the type of garment to be dried. The particular drying setting chosen will result in a particular set of control parameters that are used by the control system. For example, a cotton shirt setting would have a higher maximum temperature setting, and likely a longer time setting, than would be desirable for drying and de-wrinkling in a permanent press garment.

Referring again to FIG. 4, a door 86 is preferably mounted on the front of the housing 12 and swings open on a hinge 88. However, in some embodiments, the door 86 is hingedly mounted on one side of the drying apparatus 10 and the clothing is inserted in through the side. In others, the door is mounted on the front of the housing and slides aside on rollers to expose the open front of the housing 12. The door is preferably dimensioned to seal the lower compartment 20 of the housing such that so that a substantial portion of air does not escape therethrough. In practice, this means that some air may escape, but that the flow of air from the exhaust vent hole, through the lower compartment, and into the intake vent hole is not substantially impaired. The preferred door 86 includes a transparent viewing panel 90 to allow a user to see the clothing disposed within the compartment. However, in others, the door is solid and provides no such viewing panel. Finally, in some embodiments, the door 86 is fitted with a contact (not shown) that allows the control system to determine whether or not the door is open or closed and to energize or de-energize the mechanical assembly based upon the open or closed position of the door.

The drying apparatus of the present invention is readily adapted for use in a number of different applications. For example, the apparatus may be used as an air freshener by opening the door and placing a typical automotive air freshener on the hanging device. Similarly, heated versions of the apparatus are readily adapted for use in home dry cleaning, by hanging the cleaning bag on the hanger. In such uses, the dry cleaned clothing need not be ironed as they emerge wrinkle free from the apparatus.

Although the present invention has been described in considerable detail with reference to certain preferred versions thereof, other versions or applications would be readily apparent to those of ordinary skill in the art. Therefore, the spirit and scope of the appended claims should not be limited to the description of the preferred versions contained herein.

What is claimed is:

1. An apparatus for drying and de-wrinkling an article of clothing, said apparatus comprising:

a housing having an interior, an exterior and at least one side, wherein said interior of said housing comprises an upper compartment, a lower compartment, and a dividing wall separating said upper compartment and said lower compartment, wherein an exhaust hole is disposed through said at least one side in said upper compartment of said housing, wherein an intake hole and are outflow hole are disposed through said dividing wall; and wherein at least two vent holes are disposed in said lower compartment for allowing an exhaust of air therethrough, said holes of sufficient number and size, and disposed at a location within said lower compartment, wherein an overall pressure within said lower compartment is reduced such that a volume of air is allowed to pass over the article of clothing at a sufficient velocity to force moisture held within the clothing downward towards a bottom of the article of clothing;

a mechanical assembly disposed with said upper compartment of said housing, said mechanical assembly comprising a blower dimensioned to blow air downward through said outflow hole into said lower compartment of said housing;

an exhaust fan disposed in fluid communication with said exhaust hole and adapted to control a flow of air through said exhaust hole;

a control system disposed within said upper compartment of said housing for controlling an operation of said blower and for controlling an operation of said exhaust fan.

2. The apparatus as claimed in claim 1, wherein said lower compartment of said housing comprises an open front, and wherein a door is movably attached to said housing.

3. The apparatus as claimed in claim 2 wherein said door comprises a substantially transparent viewing panel.

4. The apparatus as claimed in claim 2 wherein said door further comprises a contact in communication with said control system for controlling an operation of said mechanical assembly based upon a position of said door.

5. The apparatus as claimed in claim 1 wherein said mechanical assembly further comprises a heater, a thermostat and a humidity sensor.

6. The apparatus as claimed in claim 5 wherein said control system comprises means for accepting an input from a user, means for accepting a temperature input from said thermostat, means for accepting a humidity input from said humidity sensor, and means for controlling said heater, said fan and said exhaust fan based upon said temperature input and said humidity input.

7. The apparatus as claimed in claim 6 wherein said means for accepting an input from a user, means for accepting said temperature input from said thermostat, means for accepting said humidity input from said humidity sensor, and means for controlling said heater, said fan and said exhaust fan based upon said input from said user and said temperature input and said humidity input, comprise a microprocessor and a memory into which a control algorithm is stored.

8. The apparatus as claimed in claim 7 wherein said input from said user comprises a drying setting and wherein said control algorithm comprises a means for determining a temperature set paint and a humidity set point based upon said drying setting, means for comparing said temperature input and said humidity input with said temperature set point and said humidity set point, and means for sending an output to said open or close said exhaust fan when a temperature exceeds said temperature set point or said humidity exceeds said humidity set point.

9. The apparatus as claimed in claim 8 wherein said control system further comprises a timer for measuring an actual drying time, and wherein said control algorithm further comprises a means for determining a desired drying time based upon said drying setting, means for comparing said actual drying time with said desired drying time, and means for sending an output to cease operation of said mechanical assembly when said actual drying time exceeds said desired drying time.

10. The apparatus as claimed in claim 1 further comprising a means for accepting an input from a user.

11. The apparatus as claimed in claim 10 wherein said means for accepting an input from a user comprises a control console disposed upon said exterior of said housing.

12. The apparatus as claimed in claim 1 further comprising a hanging device disposed within said lower compartment of said housing.

13. An apparatus for drying and de-wrinkling an article of clothing, said apparatus comprising:

a housing having an interior, an exterior and at least one side, wherein said interior of said housing comprises an upper compartment, a lower compartment, and a dividing wall separating said upper compartment and said lower compartment, wherein an outflow hole is disposed through said dividing wall, and wherein at least one hole is disposed through said lower compartment of said housing for allowing air to exhaust therefrom said at least one hole being of sufficient number and size to reduce an overall pressure within the lower compartment such that a volume of air is allowed to pass over the article of clothing at a sufficient velocity to force moisture held within the clothing downward towards a bottom of the article of clothing;

a mechanical assembly disposed with said upper compartment, said mechanical assembly comprising a blower dimensioned to blow air downward into said lower compartment; and a control system disposed within said upper compartment of said housing for controlling an operation of said blower.

14. The apparatus as claimed in claim 13 wherein said control system comprises a timer measuring an actual drying time.

15. The apparatus as claimed in claim 13, wherein said lower compartment of said housing further comprises an open front, and wherein a door is movably attached to said housing.

16. The apparatus as claimed in claim 1 wherein said lower compartment comprises a bottom and wherein said at least two holes comprises a plurality of holes disposed through said bottom of said lower compartment.

17. The apparatus as claimed in claim 13 wherein said lower compartment comprises a bottom and wherein said at least two holes comprises a plurality of holes disposed through said bottom of said lower compartment.

* * * * *